US005237956A

United States Patent [19]

Igeta

[11] Patent Number: 5,237,956

[45] Date of Patent: Aug. 24, 1993

[54] BOOKMARK FOR THE CORNER

[76] Inventor: Kiyoko Igeta, 16-21, Toyotsu-cho, Suita-shi, Osaka 564, Japan

[21] Appl. No.: 869,510

[22] Filed: Apr. 16, 1992

[30] Foreign Application Priority Data

May 10, 1991 [JP] Japan ..... 3-62973[U]

[51] Int. Cl.[5] ..... B42D 9/00

[52] U.S. Cl. ..... 116/234; 281/42; 283/81

[58] Field of Search ..... 116/234, 237; 281/42; 283/81

[56] References Cited

U.S. PATENT DOCUMENTS 486,755 11/1892 Bowman ..... 283/42

538,706 5/1895 Sexton ..... 116/234

2,853,043 9/1958 Bitterman et al. ..... 116/234

4,544,182 10/1985 Spring ..... 283/42

*Primary Examiner*—Daniel M. Yasich

*Attorney, Agent, or Firm*—Wenderoth, Lind & Ponack

[57] ABSTRACT

A bookmark for the corner of a leaf of a book comprises two sheets of a body of the bookmark fitted on the corner of the leaf by holding the corner. A bookmark for the corner of a leaf has two belt-shaped holding parts for the purpose of fitting and fixing the body of the bookmark on the leaf. The belt-shaped holding parts extend from the top and the side of the body of the bookmark. The two belt-shaped bands of the holding parts hold the upper end and the side end of the corner of the leaf.

7 Claims, 3 Drawing Sheets

BOOKMARK FOR THE CORNER

FIELD OF THE INVENTION

This invention relates to a bookmark to be put between leaves of a book or a notebook to mark the pages.

PRIOR ART

As a bookmark, a sheet of slight thick paper in the form of a strip of fancy paper, to which an ornamental string is tied at the upper portion thereof, is known in general. However, the conventional bookmark has a defect in that a bookmark comprising only a sheet of thick paper sometimes slips from a page.

In order to eliminate this defect, a bookmark for a corner, comprising two sheets for the body of the bookmark laid one on top of another, which can be affixed by holding the corner of a page with the top and side of the bookmark, has been invented.

However, several defects still remain in this characteristic bookmark for a corner and thus was of no practical use because of its inconvenience.

The bookmark in the prior art has the following defects.

Since the conventional bookmark holds the corner of a page with a fixing part of the top and a fixing part of the side of the body of the bookmark itself, the following defects remain.

a) An inconvenience in fitting and handling

Since the bookmark slips from a leaf, and is not affixed, if the whole of a fixing part of the top and a fixing part of the side, extending narrowly along the body of the bookmark, are put at an inclination, it requires time to fit and is inconvenient.

b) An inconvenience in observation

Since the upper end and the side end of the corner of a leaf are covered with the whole of the long and narrow top and side of the body of the bookmark, and the condition of the fitted bookmark cannot be observed well, the bookmark is often fitted improperly.

c) An inconvenience in maintaining stability

Since the whole of the bookmark is placed too much toward the corner, only the corner of a leaf becomes heavy, and when the leaf of a book is turned over, the leaf is folded and the bookmark is not stable, and sometimes slips from the leaf.

d) A limitation in design

Although the form of the bookmark is optional, since the fixing part of the top and the fixing part of the side must be located at an angle of 90°, and a rectilinear part for holding is required, the design of the bookmark is limited.

e) A limitation in size

If the body of the bookmark is made a little bigger, the above-mentioned defects are emphasized and the bookmark becomes considerably inconvenient.

The object of the present invention is to solve the above-mentioned defects of the conventional bookmark and to provide a practical bookmark for the corner of a page of a book.

SUMMARY OF THE INVENTION

As a result of various tests on a fixing part of a top and a side which fit a bookmark on the corner of a leaf, the length of the fixing part, as long as the size of the bookmark is ordinary, is found to be not necessarily long. A length of 2–3 cm is enough to maintain stability, and it is found that it is easier to fit the bookmark if the length of the fixing part is shorter.

In order to shorten the length of the fixing part holding the upper end and the side of the corner, the whole of a bookmark is formed in the shape of a belt. Further, in addition to the belt-shaped bookmark, in order to form various types of bookmarks which are more adequate as bookmarks, the body of the bookmark is designed in an optional form, and the belt-shaped bookmark and the body of the bookmark are formed as one by adding a belt-shaped hold part only for holding to both the top and the side of the body of the bookmark. As a result, various problems are solved.

Comparing the representative embodiment of this invention with the conventional invention according to explanative FIGS. 4 and 5, the main difference between the two is the presence of a hold part (5). In the conventional bookmark as shown in FIG. 5, the length of the fixing part holding leaves is almost equal to the whole bookmark in length and width. On the other hand, in this invention, as shown in FIG. 4, according to the two belt-shaped hold parts (5), the length of the parts holding leaves is clearly shorter than the length and the width of the body of the bookmark. Further, there is space at the end of the corner of a leaf. This fact means that the center of gravity of the body of the bookmark, after being fitted, has transferred from the corner of a leaf in the direction of the center of the leaf.

As mentioned above, by this invention, wherein two belt-shaped hold parts are provided for fitting and fixing, and the hold parts hold the end of the corner of a leaf with the belt-shaped band, the defects of the conventional bookmark for the corner of a leaf are eliminated.

DETAILED DESCRIPTION OF THE PREFERRED EMBODIMENT

Figure 1:
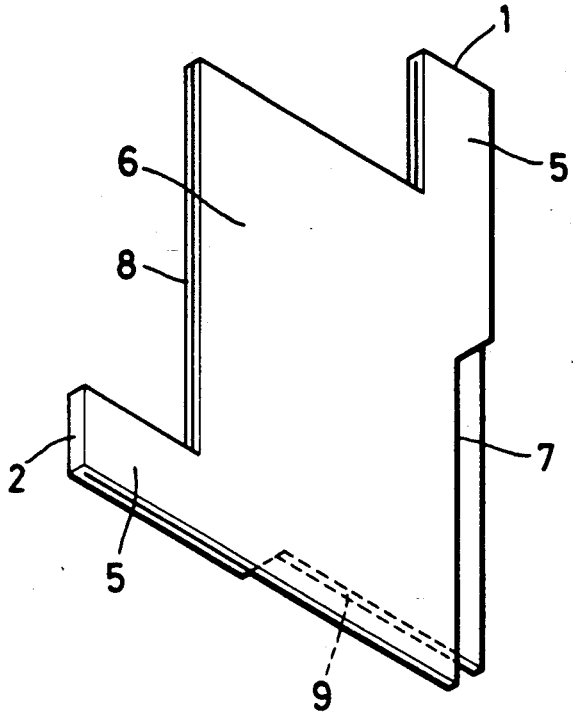
FIG. 1 is a perspective view of a first embodiment of a bookmark according to the present invention.

In FIG. 1, a leaf is inserted into a side cut (7) from the lowest part thereof having a different form between a body portion (6) and a body portion (8) of the bookmark. The bookmark is fitted so as to hold the upper end and the side of the corner of the leaf with two upper and lower belt-shaped holding parts (5).

The bookmark of this invention is fitted and fixed on the corner of the leaf by holding the upper end and the side of the corner with the belt-shaped band by means of the two hold parts (5).

The structure and operation of additional parts which bring the operation of this invention into full play are described in the following.

First, a top (1) and a side (2) are located at an angle of 90° to each other so that when the bookmark of this invention is fitted on a leaf of a book, the holding parts (5) connected to the top (1) and the side (2) can exactly hold on the corner of the leaf, the upper end and the side thereof being at an angle of 90° to each other.

Further, the reason that the two holding parts (5) are extended vertically in the shape of a belt from each of the top (1) and the side (2) is because when the bookmark is fitted on a leaf, if these holding parts and the ends of the leaf are at right angles to each other, it is possible to know immediately that the bookmark is fitted exactly without any inclination.

Furthermore, the rectangular body portion (6) and the body portion (8), or sheets of belt-shaped thin board (3) and (4), are formed as one at a center portion, except for the two holding parts (5), because the holding parts (5) bring the most important functions of fitting and fixing of the invention into full play.

The object of providing the side cut (7) along the outer side of the body portion (6) and a bottom cut (9) along the bottom of the body portion (8) is that when the bookmark of this invention is fitted, cuts each having a different form provide a place for insertion that can be found easily from both the obverse and reverse sides of the bookmark.

As to materials used for the bookmark of this invention, thin, elastic, light and strong materials such as thin plastic sheet and high quality paper are preferable. If materials are transparent and color printing can be conducted on the materials, those materials are most appropriate.

FIG. 1 is a perspective view of a first embodiment showing the most characteristics of this invention. The top (1) and the side (2) are located at an angle of 90° to each other, and two sheets of belt-shaped thin board, having holding parts (5) extending vertically from each of the top (1) and the side (2), are laid on top of one another and affixed at the top (1) and the side (2).

The rectangular body portion (6) is formed as one with the sheet of belt-shaped thin board and forms the obverse side at the center part, except for the two holding parts (5). The rectangular body portion (8) is formed as one with the sheet of belt-shaped thin board and forms the reverse side at the center part, except for two holding parts (5).

Further, the side cut (7) is provided along the outer side of the body portion (6) and the bottom cut (9) is provided along the bottom of the body portion (8), with the form of the bodies of the bookmarks being different from each other at the cuts (7) and (9).

Figure 2:
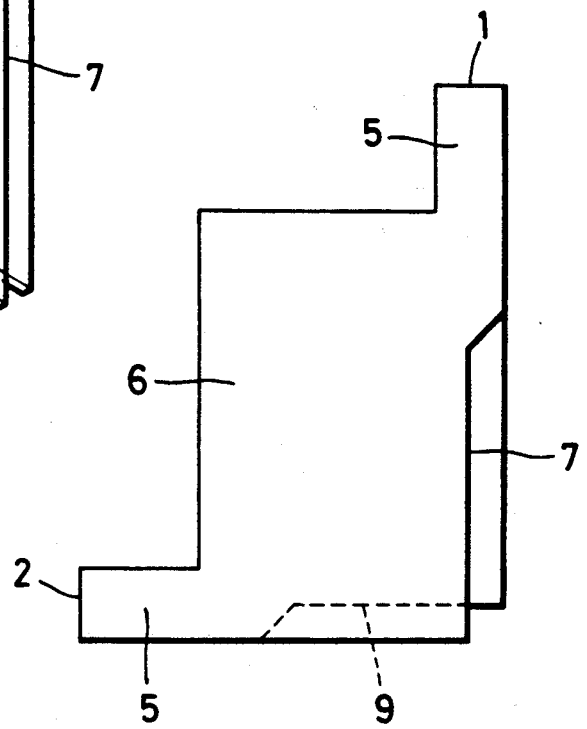
FIG. 2 is a plan view of the bookmark of FIG. 1.
Figure 3:
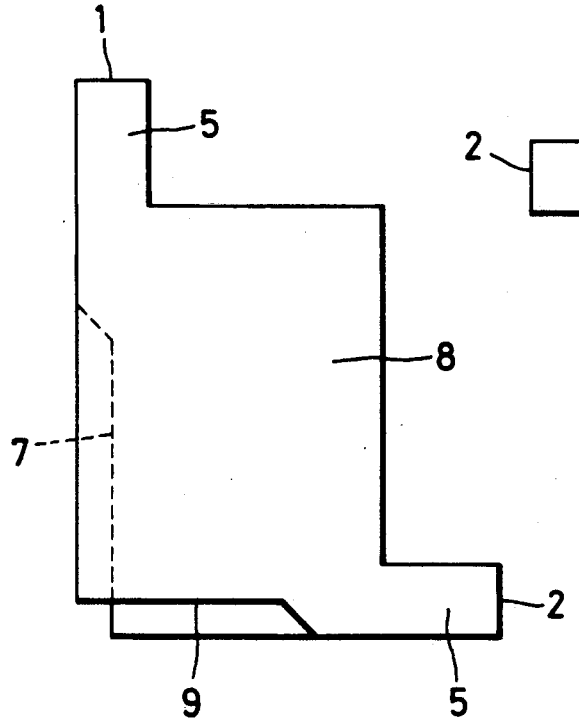
FIG. 3 is a bottom view of the bookmark of FIG. 1.

FIG. 2 is a plan view of the first embodiment and FIG. 3 is a bottom plan view of the first embodiment.

Figure 4:
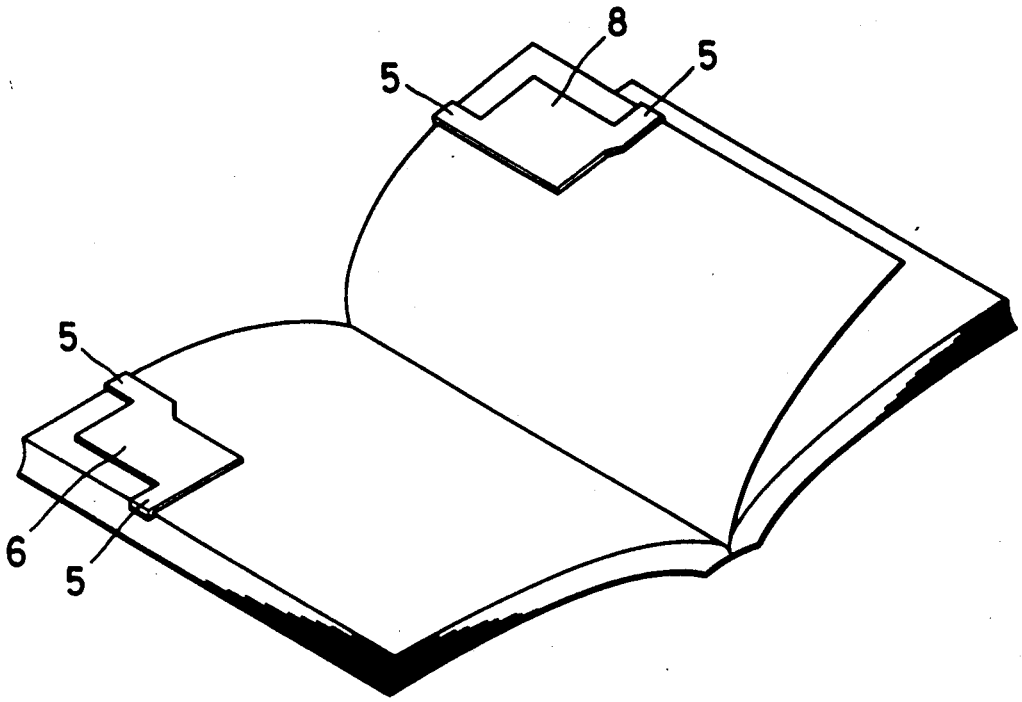
FIG. 4 is an explanatory view showing the condition of the bookmark of FIG. 1 in use.

FIG. 4 is an explanatory view showing the use of the bookmark.

The left side of FIG. 4 shows the bookmark of this invention fitted on the upper corner of the left leaf of a book. The right view shown the reverse side of the left leaf, that is, the bookmark used on a right leaf.

Figure 5:
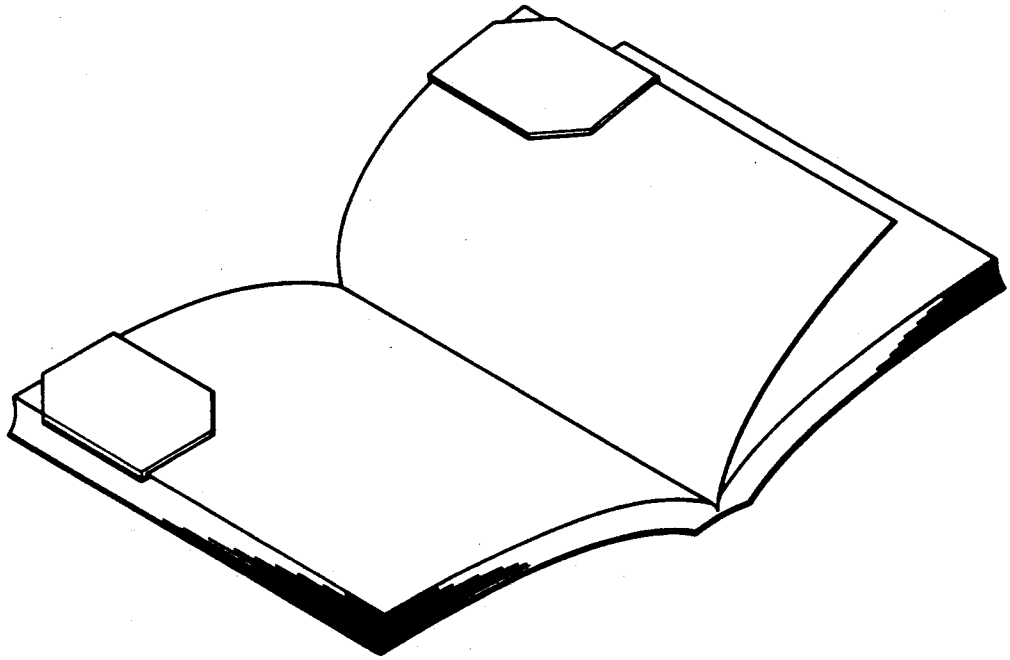
FIG. 5 PRIOR ART
FIG. 5 is an explanatory view of a conventional bookmark.

FIG. 5 is an explanatory view of a conventional bookmark for a corner in use for comparison with the bookmark of this invention.

Figure 6:
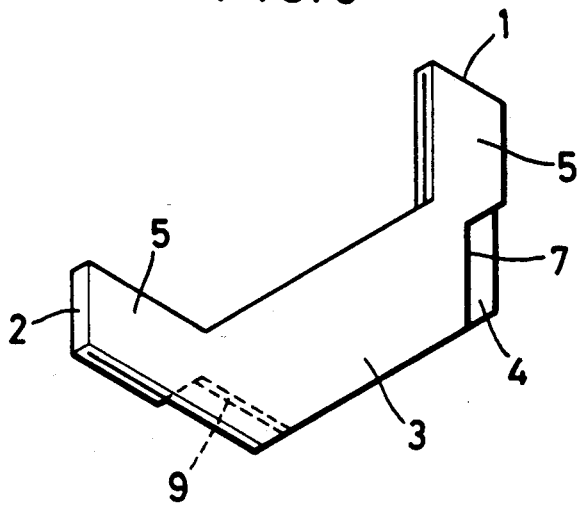
FIG. 6 is a perspective view of a second embodiment.

FIG. 6 is a perspective view showing a second embodiment. The bookmark of this embodiment is in the shape of a belt, which is similar to the first bookmark of this invention.

The top (1) and the side (2) are located at an angle of 90° to each other and the top (1) and the side (2) are connected in the shape of a belt. Although those two sides can be connected in various forms, such as in a fan shape by a quartered circular arc, in an inclined straight line shape or in the shape of a stair, in this second embodiment, the two holding parts (5) extend vertically from the top (1) and the side (2) and are connected at the center portion with the inclined belt-shaped straight line. As to the shape of the belt indicated above, the width of the belt is not necessarily constant and partly parallel.

The two sheets of belt-shaped thin board (3) and (4) are laid one on top of another in the above manner and the two sheets are affixed at the top (1) and the side (2) thereof.

The side cut (7) is provided along the outer side of the sheet of belt-shaped thin board (3) to be the obverse side and the bottom cut (9) is provided along the bottom side of the sheet of belt-shaped thin board (4) to be the reverse side. The form of the sheets is different at the cuts to form places for insertion when the bookmark is fitted.

Figure 7:
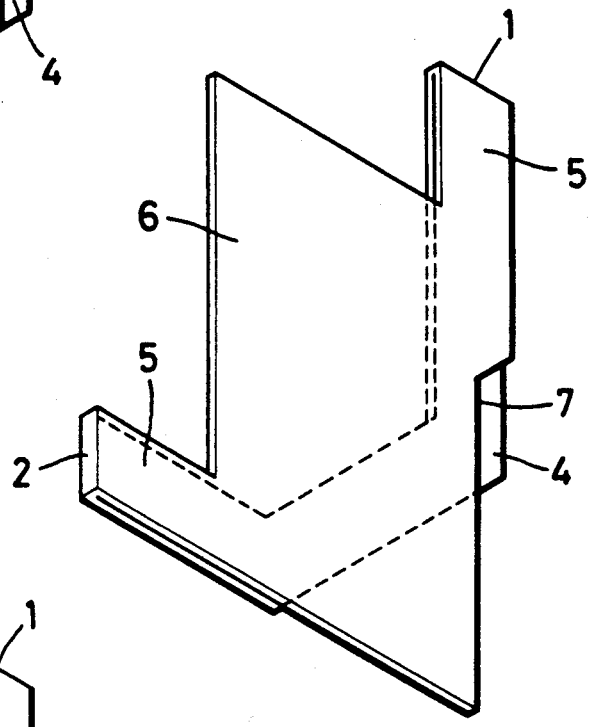
FIG. 7 is a perspective view of a third embodiment.

FIG. 7 is a perspective view showing a third embodiment.

The rectangular body portion (6), instead of a sheet of belt-shaped thin board (3), is formed as one at a center part, except for the two holding parts (5). The sheet of belt-shaped thin board (4) for the reverse side is in the shape of a belt and affixed with the holding parts (5).

The side cut (7) is provided as a place for insertion, along the outer side of the body portion (6) on the obverse side, when the bookmark is fitted. However, when the bookmark has the sheet of belt-shaped thin board (4) the obverse side, since the entire sheet of thin board (4) is in the shape of a belt, and apparently different from the form of the body portion (6) as the reverse side, it is not necessary to provide the bottom cut (9) with this sheet of belt-shaped thin board (4).

As mentioned above, in the third embodiment the one sheet of belt-shaped thin board (3) is almost rectangular. On the other hand, the whole of the other sheet of belt-shaped thin board (4) is belt-shaped.

Figure 8:
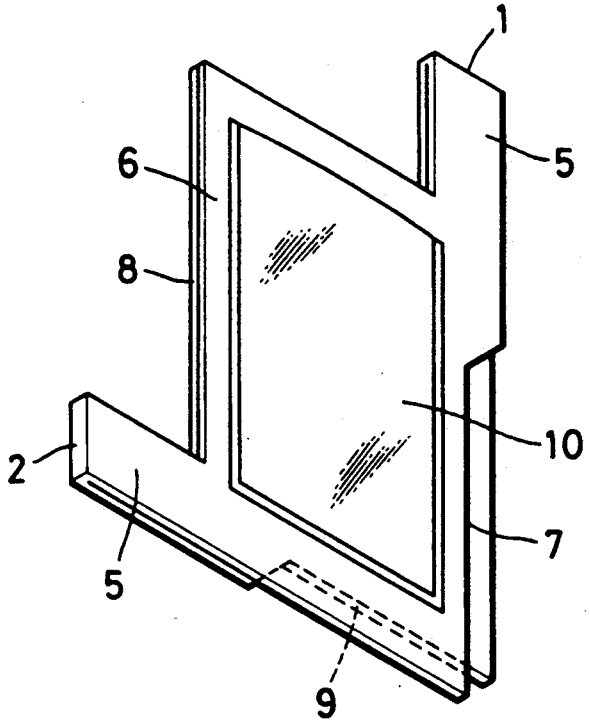
FIG. 8 is a perspective view of a fourth embodiment.

FIG. 8 is a perspective view showing a fourth embodiment. A plastic thin transparent sheet (10), which is a little smaller than the rectangular body portion (6), is put upon the rectangular body portion (6), and three sides thereof are affixed thereto to form an enclosed pouch. As a result, a memorandum or photograph can be freely inserted into the pouch from the remaining open side.

When the body of the bookmark is larger, in order to improve the stability more than one holding part can be provided in addition to the two holding parts.

As other examples, the body portion (6) and the body portion (8) can be formed in various shapes, such as the shape of a heart, a flower or an animal.

Further, if transparent plastic is used as the material of the bookmark of this invention, and a wider transparent part remains at least on one body portion of the bookmark, letters on a leaf are not concealed by the fitted bookmark. Therefore, the bookmark can be used without any inconvenience, even if the bookmark is kept fitted on a leaf.

Meanwhile, in each structure of this invention all of the names used, such as the top (1) and the side (2), the sheets of belt-shaped thin board (3) and (4), the body portion (6) and the body portion (8), and the side cut (7) and the bottom cut (9) are used only for reasons of expediency, and can be used interchangeably for their corresponding parts. Thus, if the bookmark is fitted on the right page of a book or the bottom corner, each of the names can be replaced with each other.

The two belt-shaped holding parts, independent of the body of the bookmark, are provided only for the purpose of fitting and fixing. The following results have been obtained.

a) An improvement in handling when the bookmark is fitted:

The bookmark can be fitted by means of considerably easy handling. All that has to be done is to hold the two sides of the corner of a book leaf with a narrow belt-shaped holding part.

b) An improvement in the observation of the fitting condition:

Since the upper end and the side of the corner of a leaf are not widely concealed by the bookmark, the fitting condition can be seen well. Thus, it is possible to fit the bookmark appropriately.

c) An improvement in holding and stability:

Since the fitting point of the body of the bookmark has transferred from the corner of a leaf toward the center of the leaf, the center of gravity of the bookmark is less toward the corner. As a result the stability on a leaf has been improved.

d) An improvement in a design:

Since the body of the bookmark does not itself hold the leaf, it is not necessary to form the body taking into account in the fitting condition. Thus the bookmark can be designed freely.

e) An unlimited size of the bookmark:

If the number of holding parts and the width of a belt is changed in accordance with the form and the size of the body of the bookmark, even a fair-sized bookmark can be used in practice.

As mentioned above, not only can the bookmark of this invention be freely fitted and removed on the corner of a leaf as well as the conventional bookmark, but the bookmark of this invention also has a superior character, that is, the bookmark can be seen from the upper side of a book and also can be seen from the side of a book. This invention has made a convenient bookmark for a corner practical.

What is claimed is:

1. A bookmark for placement on the corner of a page of a book, comprising:

first and second thin sheets disposed opposite to each other, both said thin sheets having a top and a side, said sheets having a side cut portion and a top cut portion;

a first holding part connected integrally to both said thin sheets at said tops thereof so as to integrally connect said thin sheets together, said first holding part provided for holding the upper edge of a page of a book; and a second holding part connected integrally to both said thin sheets at said sides thereof so as to integrally connect said thin sheets together, said holding part provided for holding the side edge of a page of a book;

wherein both said first and second holding parts are integral with said thin sheets and are connected from one said thin sheet to the other said sheet, and wherein both extend away from said thin sheets at an angle of 90° relative to each other.

2. The bookmark of claim 1, wherein said thin sheets are relatively narrow and extend diagonally between said first and second holding parts.

3. The bookmark of claim 1, wherein one said thin sheet is substantially rectangular, having edges forming 90° angles with said first and second holding parts, and the other said thin sheet is relatively narrow and extends diagonally between said first and second holding parts.

4. The bookmark of claim 1, wherein both said thin sheets are substantially rectangular, both having edges forming 90° angles with said first and second holding parts.

5. The bookmark of claim 1, wherein a clear sheet of rectangular material is affixed to one of said thin sheets so as to form a pouch having an opening.

6. A bookmark for placing on the corner of a page of a book, comprising:

first and second thin sheets disposed opposite to each other, both said thin sheets having a top and a side, located at an angle of 90° relative to each other;

a first holding part connected integrally to both said thin sheets at said tops thereof so as to integrally connect said thin sheets together, said first holding part provided for holding the upper edge of a page of a book; and a second holding part connected integrally to both said thin sheets at said sides thereof so as to integrally connect said thin sheets together, said second holding part provided for holding the side edge of a page of a book;

wherein one of said sheets has an edge that is displaced relative to a corresponding edge on the other said sheet so as to form a cut.

7. The bookmark of claim 6, wherein both said sheets have an edge recessed relative to a corresponding edge on the other said sheet so as to form both a side cut and a bottom cut.

* * * * *